US011657956B2

(12) United States Patent
Mikogami et al.

(10) Patent No.: US 11,657,956 B2
(45) Date of Patent: May 23, 2023

(54) COIL DEVICE AND PULSE TRANSFORMER

(71) Applicant: TDK CORPORATION, Tokyo (JP)

(72) Inventors: Tasuku Mikogami, Tokyo (JP); Kouyu Ohi, Tsuruoka (JP); Yusuke Kimoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 737 days.

(21) Appl. No.: 16/571,668

(22) Filed: Sep. 16, 2019

(65) Prior Publication Data

US 2020/0098511 A1 Mar. 26, 2020

(30) Foreign Application Priority Data

Sep. 20, 2018 (JP) ..... JP2018-176464

(51) Int. Cl.
*H01F 27/29* (2006.01)
*H01F 27/28* (2006.01)
*H01F 27/24* (2006.01)

(52) U.S. Cl.
CPC ..... *H01F 27/292* (2013.01); *H01F 27/2828* (2013.01); *H01F 27/24* (2013.01)

(58) Field of Classification Search
CPC ..... H01F 17/045; H01F 3/10; H01F 27/263; H01F 27/266; H01F 27/2823; H01F 27/292; H01F 41/0246; H01F 2017/0093
See application file for complete search history.

(56) References Cited

U.S. PATENT DOCUMENTS 6,157,283 A * 12/2000 Tsunemi ..... H01F 27/292 336/200
2004/0263285 A1* 12/2004 Suzuki ..... H01F 41/082 333/185
2006/0267719 A1* 11/2006 Yasuda ..... H01F 17/045 336/223
2014/0247105 A1* 9/2014 Hashimoto ..... H01F 17/045 336/221
2017/0053726 A1* 2/2017 Takagi ..... H05K 1/165
2017/0140858 A1* 5/2017 Takagi ..... H01F 27/292
2017/0316874 A1* 11/2017 Igarashi ..... H01F 27/292
2018/0130593 A1 5/2018 Sukegawa et al.
2018/0130597 A1 5/2018 Komaya et al.
2018/0277926 A1* 9/2018 Park ..... H01Q 1/2283
2019/0244748 A1* 8/2019 Igarashi ..... H01F 27/29
(Continued)

FOREIGN PATENT DOCUMENTS

CN 207781873 U 8/2018
JP 2003-077730 A 3/2003
(Continued)

*Primary Examiner* — Mohamad A Musleh
*Assistant Examiner* — Malcolm Barnes
(74) *Attorney, Agent, or Firm* — Oliff PLC

(57) ABSTRACT

A coil device 1 including a winding core 11 and flanges 12, 12, wires 31 to 34 wound around the winding core 11 and having one end located at the flanges 12, 12, and terminal electrodes 51 to 56 provided on the flanges 12, 12. The terminal electrodes 51 to 56 includes a wire connecting part 63*a*, 63*b* to which the one end of the wires 31 to 34 are connected and a mounting part 65 formed continuously to the wire connecting part 63*a*, 63*b* and to be positioned away from an axis of the winding core with respect to the wire connecting parts 63*a*, 63*b* along an outer peripheral direction of the flanges 12, 12.

11 Claims, 8 Drawing Sheets

(56) References Cited

U.S. PATENT DOCUMENTS

| | | | | |
|---|---|---|---|---|
| 2020/0066435 | A1* | 2/2020 | Igarashi | H01F 27/292 |
| 2020/0082971 | A1* | 3/2020 | Takahashi | H01F 17/045 |

FOREIGN PATENT DOCUMENTS

| | | | | |
|---|---|---|---|---|
| JP | 2003077730 | A | * | 3/2003 |
| JP | 2012-028684 | A | | 2/2012 |
| JP | 2017-041589 | A | | 2/2017 |
| JP | 2017-199840 | A | | 11/2017 |
| JP | 2018-078155 | A | | 5/2018 |
| JP | 2018-078202 | A | | 5/2018 |

* cited by examiner

COIL DEVICE AND PULSE TRANSFORMER

BACKGROUND OF THE INVENTION

The present invention relates to a coil device used as, for example, a pulse transformer.

The coil device shown in the following Patent Document 1 is known as the coil device used such as the pulse transformer. In this conventional coil device, the end of the wire forming the coil is connected to the terminal electrode having the mounting surface by thermocompression bonding.

However, in the conventional coil device disclosed in the Patent Document 1, a part of the film covering the wire is likely to be left as a film residue on the mounting surface of the terminal electrodes during thermocompression bonding. As a result, when the coil device is mounted on a substrate, a void or the like may generate in a connecting member, such as solder, which connects the mounting surface of the terminal electrode to the substrate. The void is likely to crack and reduce the connection reliability.

In addition, the Sn layer on the mounting surface of the electrode terminal may melt and reduce due to the influence of heat when connecting by thermocompression bonding. As a result, the adhesion between the connecting member, such as solder, and the terminal electrode may deteriorate, and the bonding strength may decrease.

Patent Document 1: JP Unexamined Patent Application No. 2018-78155

BRIEF SUMMARY OF INVENTION

The invention has been made in view of such circumstances, and an object thereof is to provide a coil device and a pulse transformer, those having a high bonding strength and a high bonding reliability.

In order to achieve the above object, a coil device of the invention includes a core member having a winding core and a flange, a wire wound around the winding core and having one end located at the flange, and terminal electrodes provided on the flange, wherein the terminal electrode includes a wire connecting part to which the one end of the wire is connected and a mounting part formed continuously to the wire connecting part and to be positioned away from an axis of the winding core with respect to the wire connecting part along an outer peripheral direction of the flange.

According to the coil device of the invention, the wire connecting part and the mounting part are separately provided in the terminal electrode. Thus, the film residue that may generate at the wire connecting part will unlikely to adhere to the mounting part when the one end of the wire is thermocompression bonded to the wire connecting part of the terminal electrode. As a result, when mounting the coil device on a substrate, voids and the like are unlikely to generate in the connecting members connecting the mounting surface of the terminal electrode and the substrate, suppressing generation of cracks, and improving connection reliability.

In addition, since the mounting part and wire connecting part are separately provided in the terminal electrode, the influence of heat when connecting by thermocompression bonding hardly affects the mounting part. Thus, the Sn layer on the surface of the mounting part, the layer improving the adhesion to the connection member such as solder, becomes less likely to melt. As a result, when the coil device is mounted on the substrate, the adhesion between the mounting part of the terminal electrode and the connecting member such as solder becomes good, and the bonding strength is improved.

The mounting part is formed continuously to the wire connecting part and to be positioned away from the axis of the winding core with respect to the wire connecting part along an outer peripheral direction of the flange. Thus, the wire connecting part becomes close to the winding core, and it becomes possible to shorten the length of the wire from the wire connecting part to the winding core, and the direct current internal resistance of the coil device can be lowered (reduction in DCR).

The mounting part is formed continuously to the wire connecting part and to be positioned away from the axis of the winding core with respect to the wire connecting part along an outer peripheral direction of the flange. Thus, the wire connecting part does not pop out to the outer side of the flange of the coil device, the side away from the axis of the winding core. Therefore, the coil device can be made compact, the coil device can be easily transported and handled, and the handling property when mounting is improved.

Further, the mounting part is preferably formed in proximity to the wire connecting part, in which case the DCR can be further reduced. Furthermore, as for the terminal electrodes positioned on both sides of the axis of the winding core, it is preferable that the wire connecting parts are positioned inside, the axis side, of the respective mounting parts. In this case, it is possible to carry out thermocompression bonding of the wire to each wire connecting part at once by the heater for thermocompression bonding.

Preferably, the wire connecting part that is disposed at a position lower than the mounting part along the height direction of the flange. By configuring in this manner, the risk of the film residue that may generate in the wire connecting part adhering to the mounting part is further reduced. In addition, the influence of heat when wire connecting by thermocompression bonding is further reduced in the mounting part. Furthermore, when the coil device is mounted on a substrate or the like, not wire connecting part but the mounting part of the terminal electrode contacts the connecting part of the substrate. Thus, the connection strength between the mounting part of the terminal electrode and the substrate improves and the connection reliability also improves.

The stepped part prevents a lateral shift of the end (the lead) of the wire when winding starts or ends on the winding core, and the ends of the wires can be appropriately connected to the wire connecting part. In addition, the presence of the stepped part further reduces the possibility that the film residue that may be generated in the wire connecting part adheres to the mounting part.

The flange may have a first region in which the wire connecting part is disposed and a second region in which the mounting part is disposed. A stepped part may be formed according to the stepped part formed on the terminal electrode between the first region and the second region. Alternatively, a gap space larger than the gap between the wire connecting part of the terminal electrode and the first region may be formed between the mounting part of the terminal electrode and the second region. In addition, the first region and the wire connecting part are preferably not attached, and the second region and the mounting part are preferably not attached.

The terminal electrode preferably further includes an installation part continuously formed to the mounting part at a position different from the connection part between the wire connecting part and the mounting part. And the installation part is preferably fixed by such as an adhesive on the outer surface of the flange. With this configuration, there is no need to fix the wire connecting part and the mounting part of the terminal electrode to the flange, and such as a heat and impact resistance of the coil device after mounting improves.

In the terminal electrode, an area of the wire connecting part is preferably smaller than an area of the mounting part in the terminal electrode. With this configuration, the heat capacity of the wire connecting part can be relatively reduced, and the influence of the heat when thermocompression bonding of the wire on the mounting part can be reduced.

The width of the wire connecting part may be narrower than the width of the mounting part along the axis direction of the winding core. With this configuration, the area of the wire connecting part can be made smaller than the area of the mounting part. Preferably, the wire connecting part is formed continuously to an edge of the mounting part close to the winding core. With this configuration, the wire connecting part becomes close to the winding core, and it becomes possible to shorten the length of the wire from the wire connecting part to the winding core, and it is possible to further reduce DCR.

Preferably, an exposed surface, where the outer surface of the flange is exposed, is formed between the edge of the wire connecting part close to the winding core and the inner side face of the flange close to the winding core. More preferably, the exposed surface is chamfered. With this configuration, it is possible to increase the angle at which the end of the wire contacts the edge of the winding core side of the wire connecting part, and to reduce a damage to the end of the wire.

One of the pluralities of terminal electrodes provided in the flange has a wide wire connecting part wider than the wire connecting part of the other terminal electrodes. The ends of two or more wires may be connected to the wide wire connecting part side by side along the outer circumferential direction of the flanges.

The pulse transformer of the invention includes any one of the coil devices described above.

Figure 1:
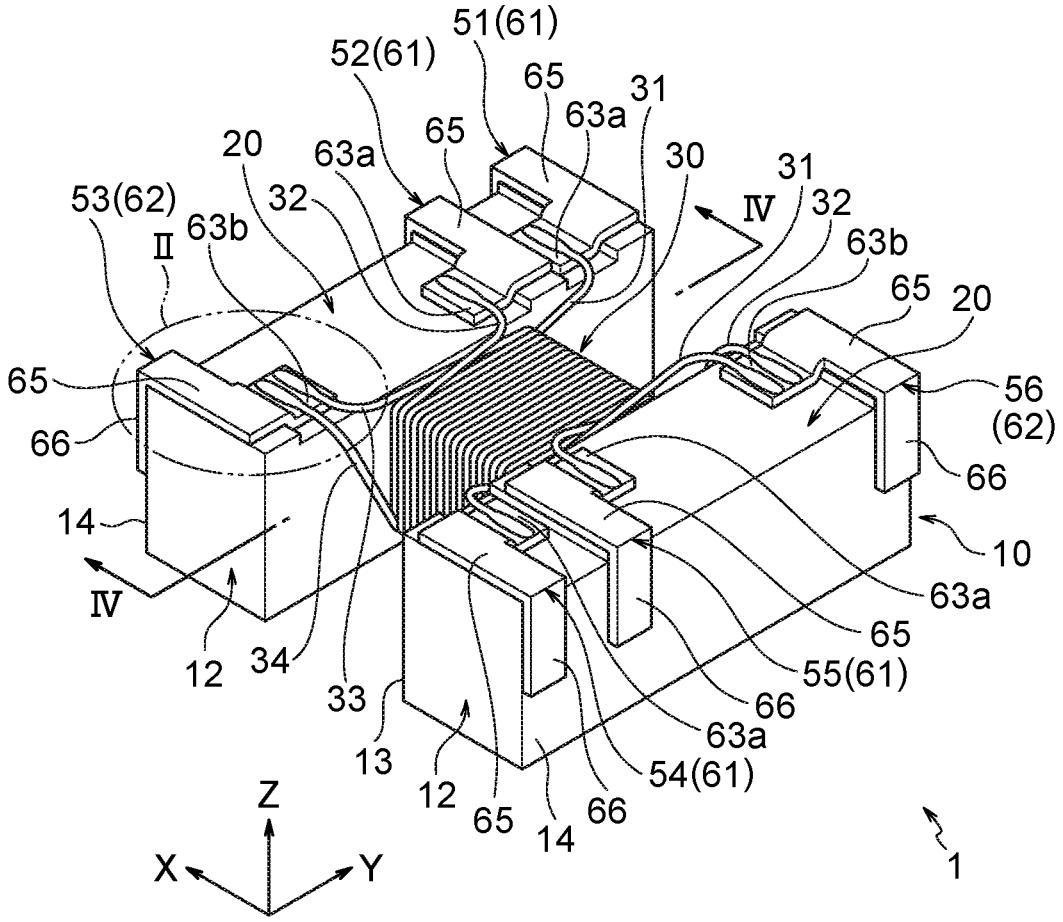
FIG. 1 is a perspective view of the coil device according to an embodiment of the invention.
Figure 2:
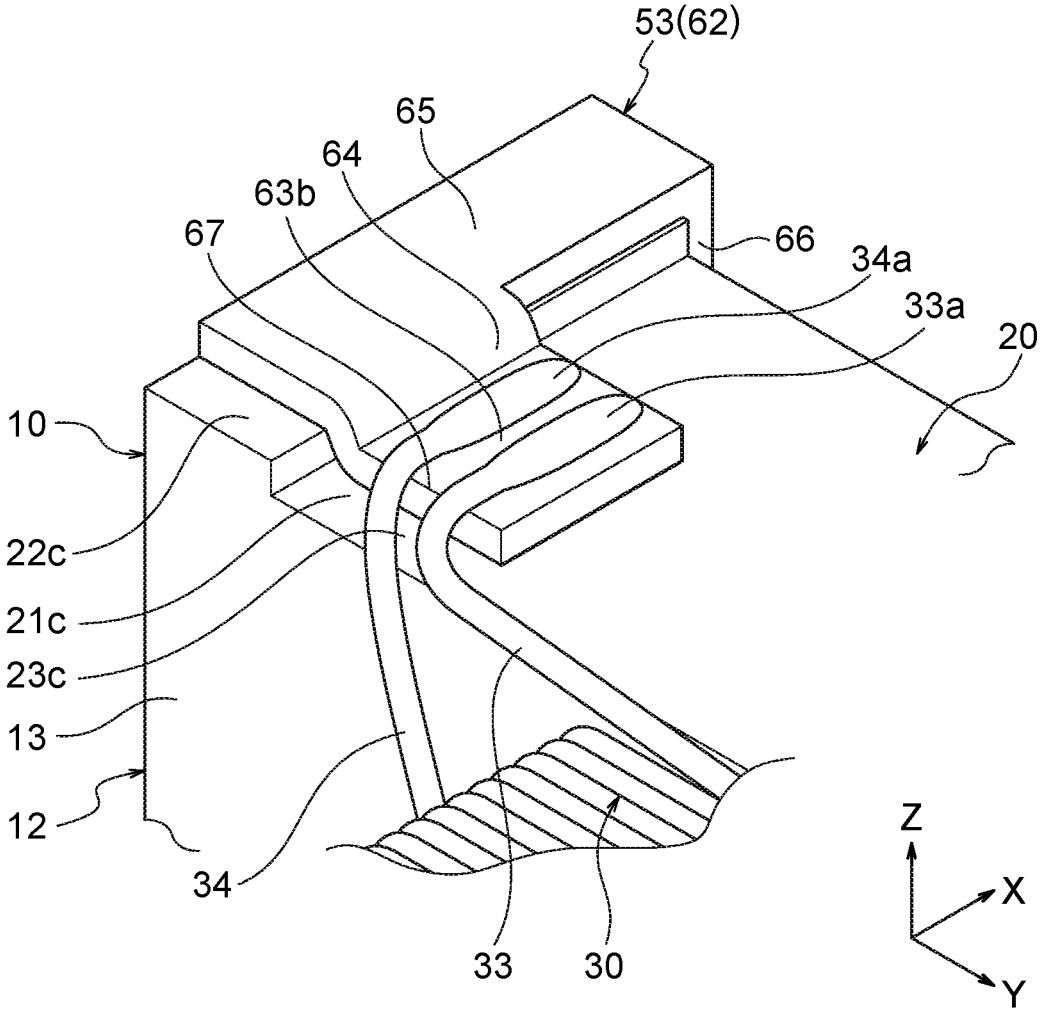
FIG. 2 is a partial perspective view of the coil device shown in FIG. 1 and an enlarged view of the part II in FIG. 1.

Hereinafter, the invention will be described based on embodiments shown in the drawings.

As shown in FIG. 1, the coil device 1 is a surface mount type coil component used such as a pulse transformer. The coil device 1 has a drum core 10, a coil part 30, and terminal electrodes 51 to 56 as drum-shaped core members.

In the coil device 1, the upper surface in the Z-axis direction in FIG. 1 is the mounting surface, when the coil device 1 is mounted on such as a substrate. In the following description, X-axis is parallel to the winding axis of the coil part 30 of the coil device 1, Z-axis is parallel to the height direction of the coil device 1, and Y axis is substantially vertical to the X-axis and the Z-axis.

The external size of the coil device 1 is not particularly limited, and the X-axis length may be 3.0 to 6.0 mm, the Y-axis width may be 3.0 to 6.0 mm, and the Z-axis height may be 1.5 to 4.0 mm.

Figure 4:
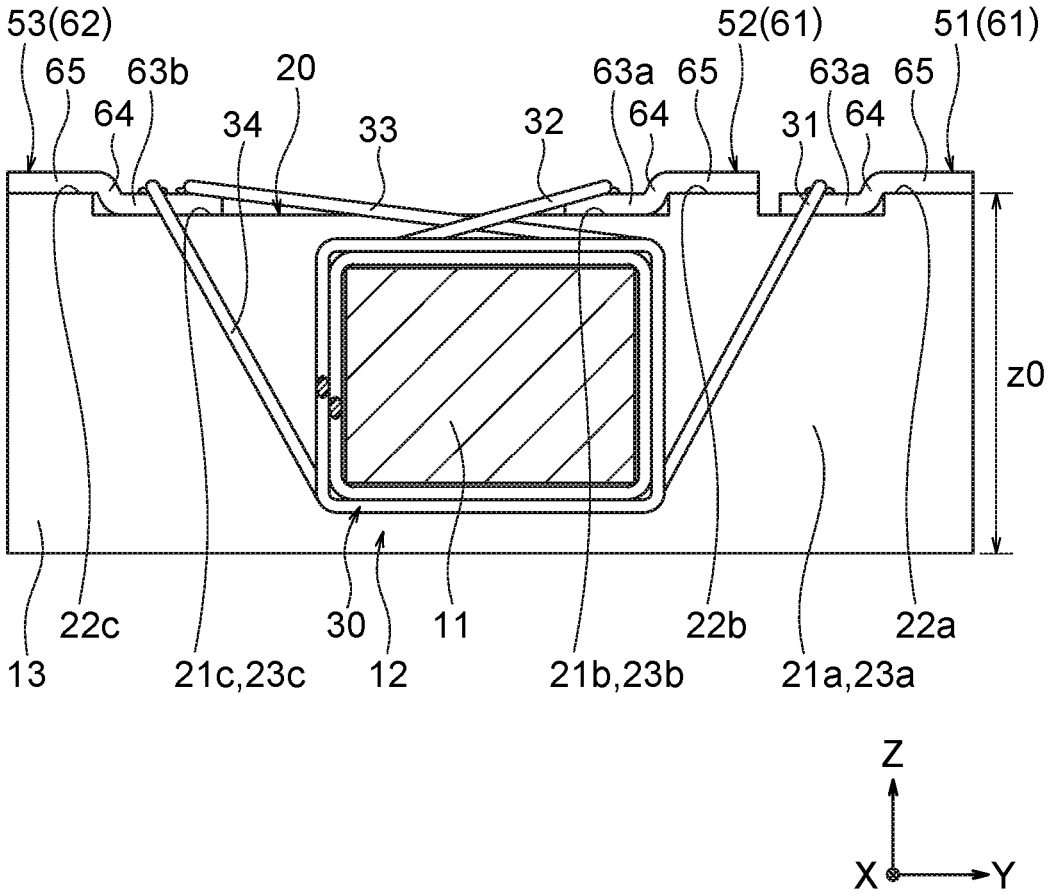
FIG. 4 is a cross-sectional view of the coil device shown in FIG. 1, taken along IV-IV.

The drum core 10 has a rod-like part (winding core 11 shown in FIG. 4) around which the coil part 30 is wound, and a pair of flanges 12, 12 provided at both axial ends of the winding core 11. As shown in FIG. 4, the cross-sectional shape of the winding core 11 is a substantial square in the embodiment, however it is not particularly limited and may have a shape of polygon, circle, ellipse, etc. As shown in FIG. 1, although the external shape of the two flanges 12, 12 have a substantially rectangular parallelepiped of the same shape, both may mutually differ in shape or size.

The drum core 10 is made of a magnetic material including for example, a magnetic material having a relatively high permeability such as a Ni—Zn based ferrite and a Mn—Zn based ferrite, or a magnetic powder such as a metal magnetic material.

Figure 3:
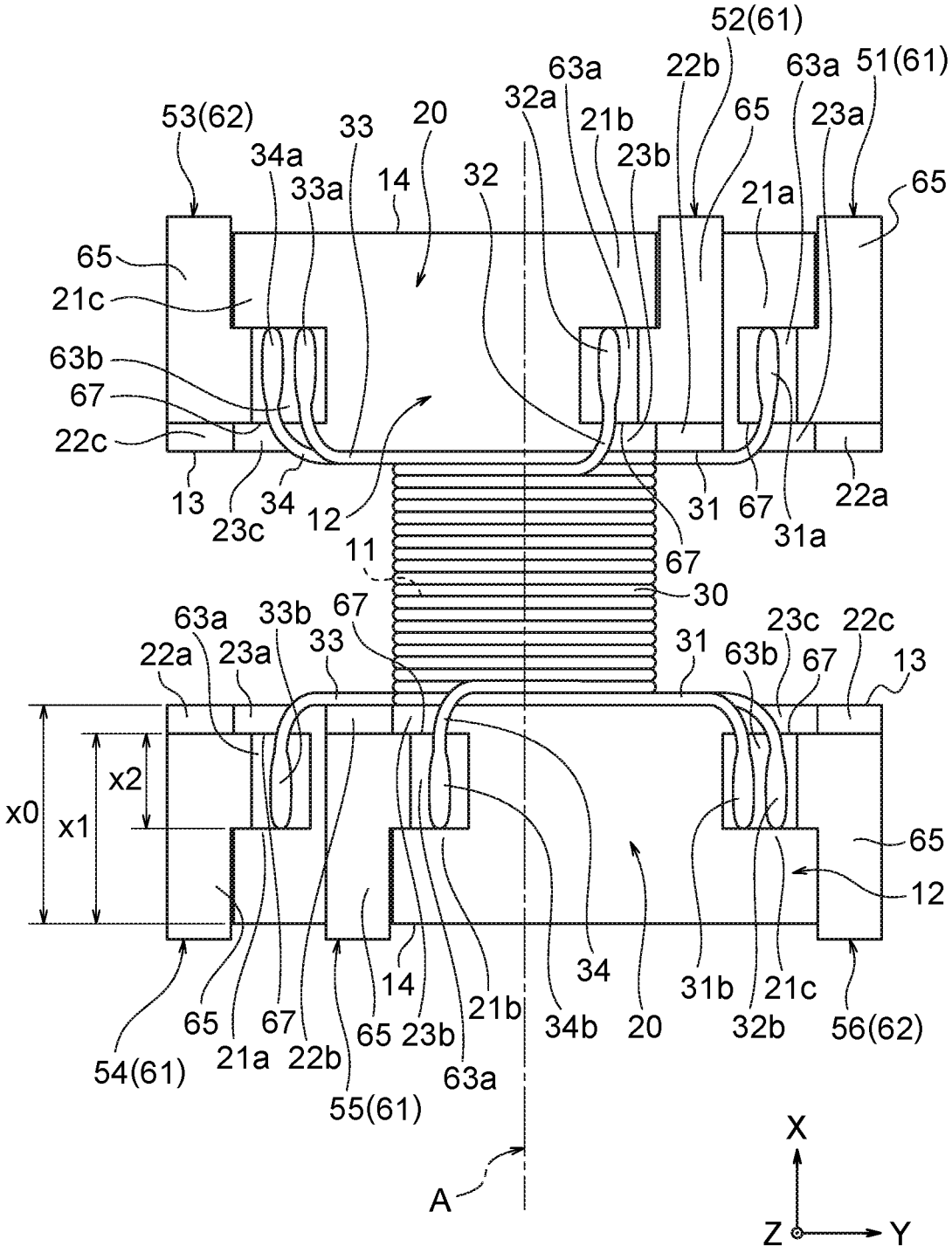
FIG. 3 is a plan view of the coil device shown in FIG. 1

As shown in FIG. 3, the two flanges 12, 12 are arranged substantially parallel to each other at a predetermined interval in the X-axis direction. Both ends of the winding core 11 in X-axis direction are connected to the central parts of each inner surface 13, 13 in Y-axis direction facing the pair of flanges 12, 12.

In each of the flanges 12, 12, three of the first to the third terminal electrodes 51 to 53 are formed on the mounting face 20 of one of the flanges 12, three of the first to the third terminal electrodes 51 to 53 are disposed on the mounting face 20 of one flange 12, and three of the forth to the sixth terminal electrodes 54 to 56 are disposed on the mounting face 20 of the other flange 12.

A coil part 30 is formed on the winding core 11 of the drum core 10. According to the embodiment, the coil part 30 has four wires 31 to 34 wound around the winding core 11. The first wire 31 and the second wire 32 constitute a primary coil as the pulse transformer, and the third wire 33 and the fourth wire 34 constitute a secondary coil as the pulse transformer. The first wire 31 and the second wire 32 forming the primary coil are wound in opposite directions, and the third wire 33 and the fourth wire 34 forming the secondary coil are wound in the opposite direction.

As shown in FIG. 3, the respective end 31*a* to 34*a* and 31*b* to 34*b* of the four wires 31 to 34 wound around in this manner is connected by such as thermocompression bonding to the flanges 12, 12 of the drum core 10.

Specifically, one end 31*a* of the first wire 31 is connected to the first terminal electrode 51, one end 32*a* of the second wire 32 is connected to the second terminal electrode 52, and one ends 33*a*, 34*a* respectively of the third wire 33 and the fourth wire 34 are both connected to the third terminal electrode 53.

Further, the other ends 31*b*, 32*b* of the first wire 31 and the second wire 32 are both connected to the sixth terminal electrode 56, the other end 33*b* of the third wire 33 is connected to the fifth terminal electrode 55, and the other end 34*b* of the forth wire 34 is connected to the forth terminal electrode 54.

The wires 31 to 34 are wound in such configuration and connect to the terminal electrodes 51 to 56. Therefore, the first terminal electrode 51 and the second terminal electrode 52 form a primary coil side terminal, an input side terminal. And the fourth terminal electrode 54 and the fifth terminal electrode 55 form a secondary coil side terminal, an output side terminal. The third terminal electrode 53 and the sixth terminal electrode 56 are center taps on the primary coil side (input side) and the secondary coil side (output side), respectively.

Each wire 31 to 34 is made by a covered conductive wire. For example, a core material made of a good conductor having high conductivity such as copper (Cu) is covered with an insulating material made of an imide modified polyurethane, and further the outermost surface is covered with a thin resin film such as polyester. However, the material of the core material or the film material of the wires 31 to 34 are not limited thereto.

Further, the wire diameter, the number of turns, the method for winding, the number of layers of the wire wound around coil 30, etc. of each wire 31 to 34 in the coil part 30 may be determined according to the properties of the obtained coil device 1. In the embodiment, the wire diameter and the number of turns in each wire 31 to 34 are the same. Each pair of wires 31, 33 (or 32, 34) wound in the same direction is wound together. For example, as shown in FIG. 4, four wires are wound in two layers on the coil part 30.

Figure 5A:
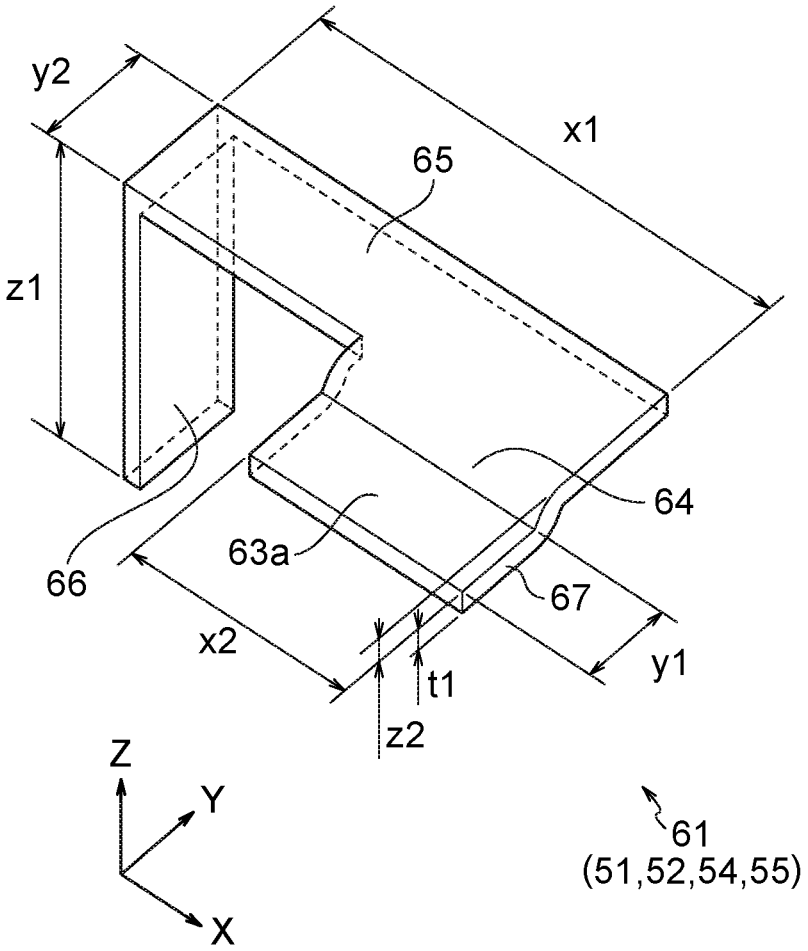
FIG. 5A is a perspective view showing a first terminal member of the coil device shown in FIG. 1.
Figure 5B:
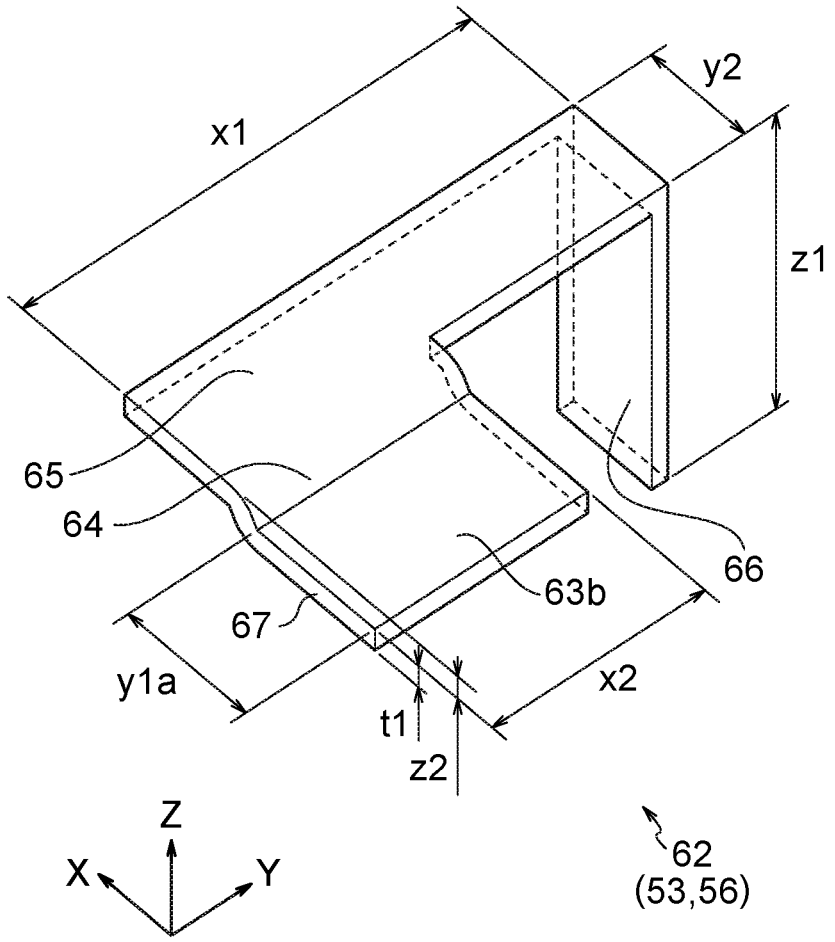
FIG. 5B is a perspective view showing a second terminal member of the coil device shown in FIG. 1.

As shown in FIGS. 5A and 5B, the terminal electrodes 51 to 56 are formed integrally by bending metallic plate terminal members 61, 62, respectively. The terminal members 61, 62 are made of, for example, a metal such as copper or copper alloy, or another conductive plates.

As shown in FIG. 5A, each of the terminal electrodes 51, 52, 54, and 55 has the same size and the same shape, and includes the wire connecting part 63*a*, the mounting part 65, and the installation part 66. The connecting part 63*a* is continuously formed proximity to one end of the mounting part 65 in the X-axis direction so as to extend in the Y-axis direction via the stepped portion 64. The installation part 66 is continuously formed and bent from the other end of the mounting part 65 in the X-axis direction toward the lower side of the Z-axis, at a position different from that of the wire connecting part 63*a*.

The height z1 of the installation part 66 in the Z-axis direction is preferably equal to or shorter than the height z0 in the Z-axis direction of the flange 12 shown in FIG. 4, and z1/z0 is preferably 0.1 to 1. As shown in FIG. 5A, the width of the installation part 66 in the Y-axis direction is preferably equal to or larger than the width y2 of the mounting part 65 in the axial direction, but it may be smaller. The width y1 of the wire connecting part 63*a* in the Y-axis direction is substantially the same as the width y2 of the mounting part 65 in the Y-axis direction, and y1/y2 is preferably within 0.1 to 1.5.

The width x2 of the wire connecting part 63*a* in the X-axis direction is preferably shorter than the width x1 of the mounting part 65 in the X-axis direction. x2/x1 is preferably ¼ to ¾, and further preferably ⅓ to ⅔. Moreover, a not shown area s1 of the wire connecting part 63*a* is smaller than a not shown area s2 of the mounting part 65. s1/s2 is preferably ¼ to ¾, and more preferably ⅓ to ⅔.

The length x1 of the mounting part 65 in the X-axis direction is preferably equal to or less than, and more preferably less than the width x0 of the mounting face 20 of the flange 12 as shown in FIG. 3. In order to form exposed surfaces 23*a* to 23*b* in which a part of the mounting face 20 (a part of the outer surface of the flange 12) is exposed between the edge 67 of the wire connecting parts 63*a*, 63*b* of the terminal electrode close to the winding core and the inner side face 13 of the flange 12 close to the winding core. The exposed surfaces 23*a* to 23*b* are preferably chamfered, including a rounding process, at the intersection between the inner side face 13 and the mounting face 20.

As shown in FIG. 5A, it is preferable that the width of the step part 64 in the Y-axis direction is either the same as the plate thickness t1 of the metallic plate terminal members 61 or is approximately 1 to 2 times the plate thickness t1. The stepped part 64 is formed between the wire connecting part 63*a* and the mounting part 65. Thus, the mounting part 65 is placed higher than the wire connecting part 63*a* in the Z-axis direction by a step height z2 of the stepped part 64 in the Z-axis direction. The step height z2 of the step part 64 in the Z-axis direction is preferably about the same as the plate thickness t1 of the terminal member 61 or is approximately 1.0 to 3.0 times the plate thickness t1. The thickness t1 is not particularly limited, but preferably 50 to 150 μm.

As shown in FIG. 5B, the terminal electrodes 53, 56 respectively has the same size and shape, and includes a wire connecting part 63*b*, the mounting part 65, and an installation part 66. The wire connecting part 63*b* is formed in proximity to one end part of the mounting part 65 in the X-axis direction so as to extend in the Y-axis direction via the stepped part 64. The installation part 66 is continuously formed and bent from the other end of the mounting part 65 in the X-axis direction toward the lower side of the Z-axis, at a position different from that of the wire connecting part 63*b*.

The height z1 of the installation part 66 in the Z-axis direction shown in FIG. 5B is preferably the same as the height z1 of the installation part 66 in the Z-axis direction shown in FIG. 5A, but they may be different. The width of the installation part 66 in the Y-axis direction shown in FIG. 5B is preferably the same as the width of the installation part 66 in the Y-axis direction shown in FIG. 5A, but may be different. Furthermore, the mounting part 65 and the step part 64 shown in FIG. 5B are also preferably similar to the mounting part 65 and the step part 64 shown in FIG. 5A, but may be different. The stepped part 64 is formed between the wire connecting part 63*b* and the mounting part 65. Thus, the mounting part 65 is placed higher than the wire connecting part 63*b* in the Z-axis direction by a step height z2 of the stepped part 64 in the Z-axis direction.

The width x2 of the wire connecting part 63*b* in the X-axis direction shown in FIG. 5B is preferably the same as the width x2 of the wire connecting part 63*a* in the X-axis direction shown in FIG. 5A, but may be different. According to the embodiment, the width y1a of the wire connecting part (a wide wire connecting part) 63*b* shown in FIG. 5B is larger than the width y1 of the wire connecting part 63*a* in the Y-axis direction shown in FIG. 5A. y1a/y1 is preferably 1.2 to 3, more preferably 1.5 to 2.5. As shown in FIG. 1, ends of two or more wires are connected side by side in the outer peripheral direction of the flange 12 to the wide wire connecting part 63*b*.

As shown in FIG. 4, the wire connecting part 63*a* shown in FIG. 5A is disposed in close contact with the first regions 21*a*, 21*b* formed on the mounting face 20 of the flange 12, but it is not necessary to be adhered, and there may be a gap. Further, as shown in FIG. 4, the mounting part 65 shown in FIG. 5A is disposed in close contact with the second regions

22*a*, 22*b* formed on the mounting face 20 of the flange 12, but it is not necessary to be adhered, and there may be a gap.

According to the embodiment, a core step part is formed between the first region 21*a* (21*b*) and the second region 22*a* (22*b*) formed on the mounting face 20 of the flange 12, and the second region 22*a* (22*b*) is disposed at a position higher than the first region 21*a* (21*b*) in the Z-axis direction. It is preferable that the stepped part 64 of the terminal member 61 is disposed on the core stepped part, and the step height of the core stepped part is substantially the same as or smaller than the stepped height z2 of the stepped part 64 shown in FIG. 5A.

That is, the gap between the mounting part 65 and the second region 22*a* (22*b*) is preferably larger than the gap between the wire connecting part 63*a* and the first region 21*a* (21*b*). The wire connecting part 63*a* and the first region 21*a* (21*b*) are preferably in close contact with each other, since the end of the wire 32 (31) is thermocompression bonded to the wire connecting part 63*a* in a later step, however, there is no problem even if there is a gap between the mounting part 65 and the second region 22*a* (22*b*). Rather, by the presence of the gap, the resilient deformation range of the mounting part 65 is increased and the heat and/or impact resistance after mounting on the substrate of the coil device 1 may be improved.

As shown in FIG. 4, the wire connecting part 63*b* shown in FIG. 5B is disposed in close contact with the first region 21*c* formed on the mounting face 20 of the flange 12, but it is not necessary to be adhered, and there may be a gap. Further, as shown in FIG. 4, the mounting part 65 shown in FIG. 5B is disposed in close contact with the second regions 22*c* formed on the mounting face 20 of the flange 12, but it is not necessary to be adhered, and there may be a gap.

According to the embodiment, a core step part is formed between the first region 21*c* and the second region 22*c* formed on the mounting face 20 of the flange 12, and the second region 22*c* is disposed at a position higher than the first region 21*c* in the Z-axis direction. It is preferable that the stepped part 64 of the terminal member 62 is disposed on the core stepped part, and the step height of the core stepped part is substantially the same as or smaller than the stepped height z2 of the stepped part 64 shown in FIG. 5B.

That is, the gap between the mounting part 65 and the second region 22*c* is preferably larger than the gap between the wire connecting part 63*b* and the first region 21*c* shown in FIG. 4. The end of the wires 33, 34 are thermocompression bonded to the wire connecting part 63*b* in a later step. Thus, the wire connecting part 63*b* and the first region 21*c* are preferably in close contact with each other, however, there is no problem even if there is a gap between the mounting part 65 and the second region 22*c*. Rather, by the presence of the gap, the resilient deformation range of the mounting part 65 is increased and the heat and/or impact resistance after mounting on the substrate of the coil device 1 may be improved.

As shown in FIG. 1, the installation part 66 of the terminal members 61, 62 shown in FIGS. 5A and 5B are respectively bonded to the outer side faces 14, 14 of the flanges 12, 12 by such as an adhesion. The mounting part 65, the step part 64 and the wire connecting part 63*a* of terminal members 61, 62 shown in FIGS. 5A and 5B are preferably not adhered to the mounting face 20 which is the upper surface of the flange 12 in the Z-axis direction shown in FIG. 1, and they are preferably freely movable.

The coplanarity (flatness) of the mounting face of the coil device 1 is improved by not adhering and fixing the wire connecting parts 63*a*, 63*b* and the mounting part 65 of the terminal electrodes 51 to 56 to the mounting faces 20, 20 of the flanges 12, 12, respectively. Further, the resistance to distortion or vibration of the substrate when the coil device 1 is mounted on the substrate or the like can be improved, and the mounting reliability can be improved.

As shown in FIG. 3, when the terminal members 61, 62 are attached to the flange 12, wire connecting parts 63*a* (63*b*) and the mounting part 65 are displaced along the outer peripheral direction (the Y-axis direction in the embodiment) of the flange 12. And the wire connecting part 63*a* (63*b*) is disposed in a position closer to the axial direction A of the winding core 11 than the mounting part 65. In particular, the terminal electrodes 52, 53 (55, 56) located on both sides of the axis A of the winding core 11 are provided with wire connecting part 63*a*, 63*b* on the inner side (axis A side) of the mounting part 65, respectively.

When producing the coil device 1 having such configuration, terminal parts 51 to 56 are installed on the drum core 10 at first. The first terminal part 61 and the second terminal part 62, corresponding to each terminal electrodes 51 to 56, are formed by disposing the wire connecting parts 63*a*, 63*b* on the first regions 21*a* to 21*c* of the mounting faces 20, 20 of the flanges 12, 12, disposing the second regions 22*a* to 22*c* on the mounting part 65, and adhering the installation part 66 to the outer side faces 14, 14 of the flanges 12, 12 with the adhesive.

In addition, the method of forming the terminal electrodes 51 to 56 is not limited to the installation method of the terminal members 61, 62, and may be formed by the baking method of the print or coated conductive film, the plating method, etc. Even with those method, the terminal electrode having the wire connecting parts 63*a*, 63*b*, the step part 64, and the mounting part 65, similar to the embodiment, can be formed on the mounting faces 20, 20, and the exposed surfaces 23*a* to 23*c* can also be formed to the mounting faces 20, 20.

After the terminal electrodes 51 to 53 and 54 to 56 are attached to the respective flange of the drum core 10, the drum core 10 is then set in a winding machine, and the wires 31 to 34 are wound around the winding core 11 of the drum core 10 in a predetermined order.

Figure 6A:
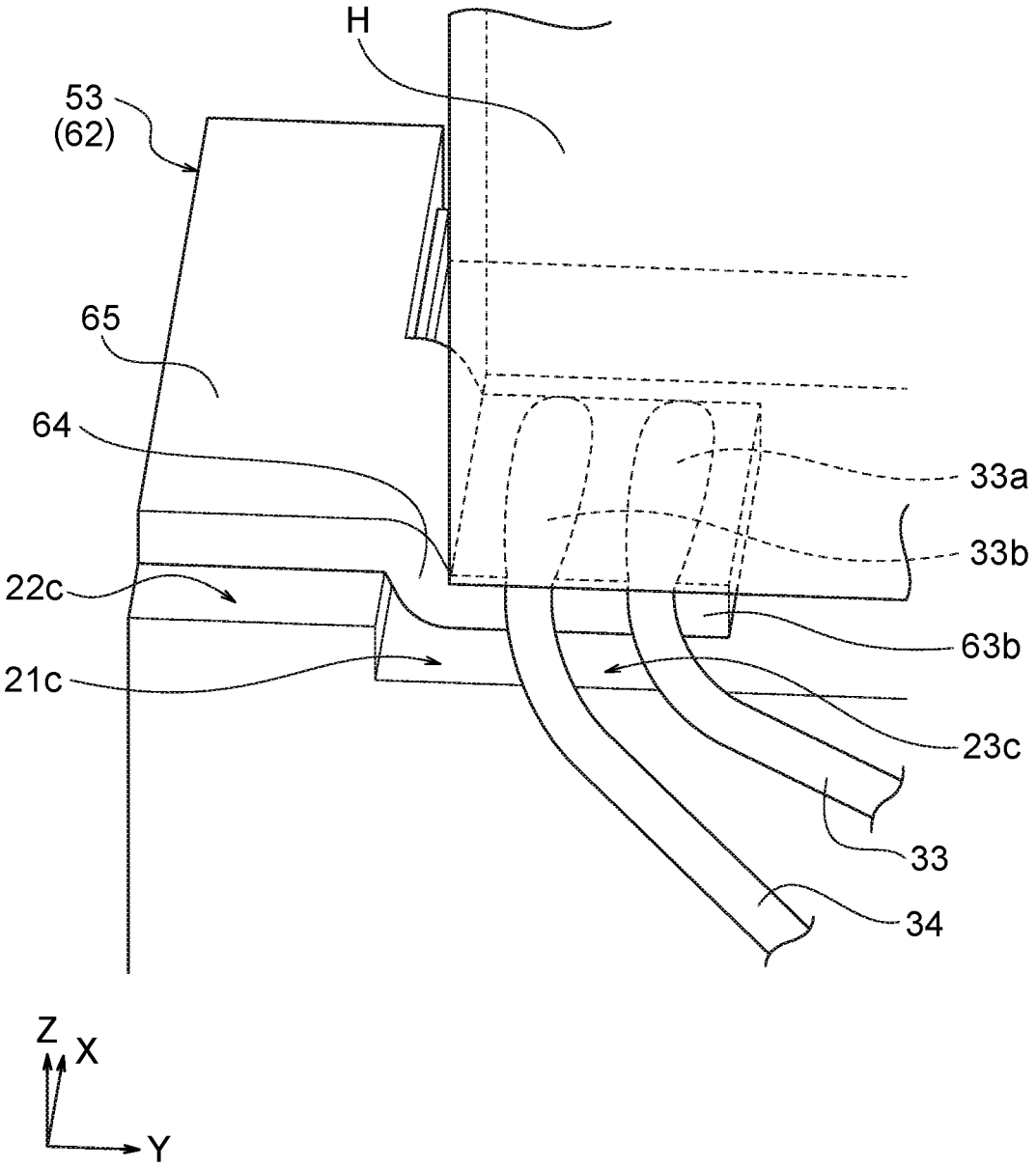
FIG. 6A is a first view illustrating a state in which a wire end is thermocompression bonded in the coil device of FIG. 1.

Next, the ends 31*a* to 34*a* and 31*b* to 34*b* of the wound wires 31 to 34 are fixed to the wire connecting parts 63*a*, 63*b* of the terminal electrodes 51 to 56 by thermocompression bonding. For example, in the connection of the end parts 33*a*, 34*a* of the third wire 33 and the fourth wire 34 to the wire connecting part 63*b* of the third terminal electrode, as shown in FIG. 6A, the heater H is pressed against the wires 33, 34 and the wire connecting part 63*b* from above and heated in the state in which a middle of the wires 33, 34 pulled out by a not shown winding machine are disposed at the wire connecting part 63*b* of the third terminal electrode 53. The thermocompression bonding of the wire 33 to the wire connecting part 63*b* and the thermocompression bonding of the wire 34 to the wire connecting part 63*b* may be performed in separate steps.

By the thermocompression bonding, the film material of the wire 33, 34 is melted or peeled. The core material of the wire 33, 34, the conductor, is exposed and the wire 33, 34 is compressed and electrically connected to the wire connecting part 63*b* of the terminal electrode 53.

Figure 6B:
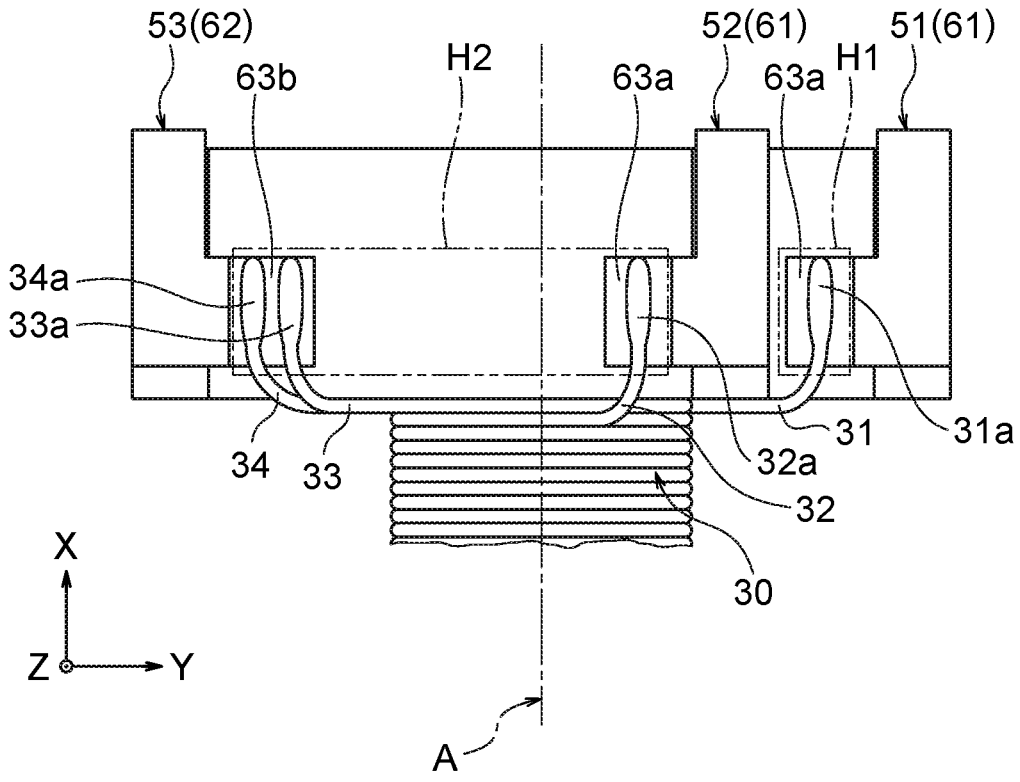
FIG. 6B is a second view illustrating a state in which a wire end is thermocompression bonded in the coil device of FIG. 1.

In the coil device 1 of the embodiment, the wire connecting parts 63*a*, 63*b* of the terminal electrodes 51 to 56 are disposed closer to the axis A side of the coil part 30 than the mounting part 65. According to the flanges 12, 12 in which three terminal electrodes 51 to 53 or 54 to 56 are disposed, as shown in FIG. 6B, two heaters H1 and H2 may be used for the thermocompression bonding or a single heater may be used for the thermocompression bonding of four wires 31 to 34 by changing the positions to be thermo-bonded.

According to the embodiment, for example, since the wire connecting part 63*a* of the second terminal electrode 52 and the wire connecting part 63*b* of the third terminal electrode 53 are both arranged on the inner side, ends of the wires 32, 34 wound around in the same direction can be simultaneously thermocompression bonded by one wide heater H2. Therefore, in the coil device 1, the producing process of thermocompression bonding the terminal electrodes 51 to 56 to the ends 31*a* to 34*a* and 31*b* to 34*b* of the wires 31 to 34 can be simplified, and the producing apparatus can be simplified.

After the thermocompression bonding of the both ends 31*a* to 34*a* and 31*b* to 34*b* of the wires 31 to 34 to the terminal electrodes 51 to 56 is completed, the wires are cut ahead from the wire connecting parts of the wire ends 31*a* to 34*a*, 31*b* to 34*b*.

In the coil device 1 of the embodiment, the wire connecting part 63*a* (63*b*) and the mounting part 65 are separately provided to the terminal electrodes 51 to 56. Thus, the possibility that the coating film residue that may generate in the wire connecting part 63*a* (63*b*) adheres to the mounting part 65 is reduced when thermocompression bonding the one end of the wires 31 to 34 to the wire connecting part 63*a* (63*b*) of the terminal electrodes 51 to 56. As a result, when mounting the coil device on a not shown circuit substrate, voids and the like are not likely to generate in the connecting members, such as solder, connecting the mounting face of the terminal electrodes 51 to 56 and the substrate. Thus, the generation of cracks is suppressing, and connection reliability is improving.

Further, since the wire connecting part 63*a* (63*b*) and the mounting part 65 are separately provided to the terminal electrodes 51 to 56, heat when connecting wire by thermocompression bonding hardly affects the mounting part 65. And the Sn layer on the surface of the mounting part 65, improving adhesion with the connection member such as solder, becomes less likely to melt. As a result, when the coil device 1 is mounted on such as a substrate, the adhesion between the mounting parts of the terminal electrodes 51 to 56 and the connecting member such as solder becomes good, and the bonding strength is improved.

Furthermore, since the mounting part 65 is continuously formed on the wire connecting part 63*a*(63*b*) so as to be displaced from the wire connecting part along the outer peripheral direction (the Y-axis direction according to the embodiment) of the flange in a direction away from the axis A of the winding core 11, the wire connecting part 63*a*(63*b*) becomes close to the winding core 11, and it becomes possible to shorten a length of the pulled-out wire from the wire connecting part 63*a*(63*b*) to the winding core 11, and the direct current internal resistance of the coil device 1 can be lowered (a reduction of DCR).

Moreover, in the embodiment, since the wire connecting part 63*a* (63*b*) is continuously formed to the edge of the mounting part 65 close to the winding core 11, the wire connecting part 63*a*(63*b*) becomes more closer to the winding core 11, and it becomes possible to shorten a length of the pulled-out wires 31 to 34 from the wire connecting part 63*a*(63*b*) to the winding core 11, and further reduction of DCR can be realized.

The mounting part 65 is formed continuously to the wire connecting part 63*a*(63*b*) and to be positioned away from the axis A of the winding core 11 with respect to the wire connecting part 63*a*(63*b*) along an outer peripheral direction of the flange 12. Thus, the wire connecting part 63*a*(63*b*) does not pop out to the outer side of the flange 12 of the coil device 1, the side away from the axis A of the winding core 11. Therefore, the coil device 1 can be made compact, transport and handling of the coil device 1 can be facilitated, and the handleability at the time of mounting can be improved.

Further, the mounting part 65 is preferably formed in proximity to the wire connecting part 63*a*(63*b*) via the step part 64, in which case the DCR can be further reduced. Furthermore, along the height direction (the Z-axis direction) of the flange 12, the wire connecting part 63*a* (63*b*) is disposed at a lower position than the mounting part 65. For this reason, the film residue that may generate at the wire connecting part 63*a*(63*b*) will more unlikely to adhere to the mounting part 65. In addition, the influence of heat when connecting by thermocompression bonding is further reduced in the mounting part 65. Furthermore, when the coil device 1 is mounted on such as the substrate, the connecting part of the substrate firstly contacts the mounting part 65 and not the wire connecting part 63*a*(63*b*) of the terminal electrode. Thus, the connection strength between the mounting part 65 of the terminal electrodes 51 to 56 and the substrate improves, and the connection reliability also improves.

The stepped part 64 is formed between the wire connecting parts 63*a*(63*b*) and the mounting part 65. The stepped part 64 prevents a lateral shift of the end (the lead) of the wires 31 to 34 when winding wires 31 to 34 start or end on the winding core 11, and the ends of the wires 31 to 34 can be appropriately connected to the wire connecting parts 63*a*(63*b*). In addition, the presence of the stepped part 64 further reduces the possibility that the film residue that may be generated in the wire connecting part 63*a*(63*b*) adheres to the mounting part 65.

Furthermore, on the terminal electrodes 51 to 56 of the embodiment, the area of the wire connecting part 63*a*(63*b*) is smaller than the area of the mounting part 65. With the configuration, the heat capacity of wire connecting part 63*a*(63*b*) can be relatively reduced, and the influence of the heat at the time of thermocompression bonding of the wires 31 to 34 on the mounting part 65 can be reduced.

Moreover, according to the embodiment, the exposed surfaces 23*a* to 23*c*, in which the outer surface of the flange 12 is exposed, is formed between the edge 67 of the wire connecting part 63*a* (63*b*) close to the winding core 11 and the inner side face 13 of the flange 12 close to the winding core 11. The exposed surfaces 23*a* to 23*c* are chamfered. By this configuration, it becomes possible to increase the angle at which the end of the wires 31 to 34 contact the edge 67 of the winding core 11 side of the wire connecting part 63*a*(63*b*), and to reduce a damage to the pulled-out ends (leads) of the wires 31 to 34.

The invention is not limited to the above embodiments and modifications may be made in various aspects within a scope of the invention.

For example, in the embodiment described above, the mounting faces 20, 20 may be configured as flat surfaces without unevenness. That is, the second regions 22*a* to 22*c* higher than the first regions 21*a* to 21*c* may not be formed on the mounting faces 20, 20. When the second regions 22*a* to 22*c* are not formed, a space is provided between each mounting part 65 of the terminal electrodes 51 to 56 and the mounting face 20. However, also in this case, the terminal members 61, 62 are maintained in the shapes shown in FIGS. 5A and 5B.

Furthermore, in the embodiment described above, a plate-like core that magnetically communicates these flanges 12, 12 is not connected to the faces opposite to the mounting faces 20, 20 of the pair of flanges 12, 12. The plate-like cores may connect to the faces by such as adhesion.

Further, in the above embodiment, the third terminal electrode 53 and the sixth terminal electrode 56 are formed as the center taps on the input side and the output side, but the center taps may be omitted depending on the application. In that case, the third terminal electrode 53 and the sixth terminal electrode 56 become unnecessary, and the coil device (a pulse transformer) can be made by two wires.

In the above embodiment, the invention has been described as a device suitable as a pulse transformer used for transmitting a pulse signal through such as a LAN cable, but the application of the invention is not limited thereto. The invention is also applicable to other coil devices such as common mode filters, and is applicable to all electronic parts in which wire leads are connected to terminal electrodes by thermocompression bonding or the methods other than thermocompression bonding.

DESCRIPTION OF REFERENCE NUMERAL

1 . . . coil device
10 . . . drum core (core member)
11 . . . winding core
12 . . . flange
13 . . . inner side face
14 . . . outer side face
20 . . . mounting face
21*a* to 21*c* . . . the first area
22*a* to 22*c* . . . the second area
23*a* to 23*c* . . . the exposed surface
30 . . . coil part
31 to 34 . . . wires
31*a* to 34*a*, 31*b* to 34*b* . . . end part (lead)
51 to 56 . . . terminal electrode
61, 62 . . . terminal members
63*a*, 63*b* . . . wire connecting part
64 . . . step part
65 . . . mounting part
66 . . . installation part
67 . . . edge of the connecting wire

What is claimed is:

1. A coil device comprising:
a core member having a winding core and a flange;
a wire wound around the winding core and having one end located at the flange; and
a terminal electrode disposed on the flange, the terminal electrode comprising:
a wire connecting part to which the one end of the wire is connected;
a mounting part integral with and adjacent to the wire connecting part and positioned away from an axis of the winding core with respect to the wire connecting part along an outer peripheral direction of the flange, the mounting part being movable to an outer surface on a mounting side of the flange on which the mounting part is arranged; and
an installation part integral with the mounting part and fixed on an outer side face of the flange.

2. The coil device according to claim 1, wherein the wire connecting part is disposed at a lower position than the mounting part along a height direction of the flange.

3. The coil device according to claim 2, further comprising:
a stepped part is disposed between the wire connecting part and the mounting part.

4. The coil device according to claim 1, wherein the flange comprises
a first region in which the wire connecting part is disposed, and
a second region in which the mounting part is disposed.

5. The coil device according to claim 1, wherein an area of the wire connecting part is smaller than an area of the mounting part on the terminal electrode.

6. The coil device according to claim 5, wherein a width of the wire connecting part along the axis of the winding core is narrower than a width of the mounting part along the axis of the winding core.

7. The coil device according to claim 5, wherein the wire connecting part is integral with an edge of the mounting part closest to the winding core.

8. The coil device according to claim 1, wherein an exposed surface is disposed on the outer surface of the flange between an edge of the wire connecting part closest to the winding core and an inner side face of the flange closest to the winding core.

9. The coil device according to claim 8, wherein the exposed surface is chamfered.

10. The coil device according to claim 1, further comprising:
a plurality of the terminal electrode; and
a plurality of the wire, wherein
one of the plurality of the terminal electrodes has a wide wire connecting part wider than the wire connecting part of another of the plurality of the terminal electrodes, and
ends of the plurality of the wires are connected side by side to the wide wire connecting part along an outer circumferential direction of the flange.

11. A pulse transformer comprising the coil device according to claim 1.

* * * * *